US007445314B2

(12) United States Patent
Lee et al.

(10) Patent No.: US 7,445,314 B2
(45) Date of Patent: Nov. 4, 2008

(54) PIEZOELECTRIC INK-JET PRINTHEAD AND METHOD OF MANUFACTURING A NOZZLE PLATE OF THE SAME

(75) Inventors: Jae-chang Lee, Hwaseong-si (KR); Jung-min Oh, Yongin-si (KR); Jae-woo Chung, Suwon-si (KR); Jong-beom Kim, Yongin-si (KR); Seung-mo Lim, Yongin-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 385 days.

(21) Appl. No.: 11/064,834

(22) Filed: Feb. 25, 2005

(65) Prior Publication Data

US 2005/0190232 A1 Sep. 1, 2005

(30) Foreign Application Priority Data

Feb. 27, 2004 (KR) ..... 10-2004-0013567

(51) Int. Cl.
*B41J 2/135* (2006.01)
*B41J 29/38* (2006.01)
*B41J 2/045* (2006.01)

(52) U.S. Cl. ..... 347/45; 347/17; 347/71

(58) Field of Classification Search ..... 347/17, 347/60, 64

See application file for complete search history.

(56) References Cited

U.S. PATENT DOCUMENTS 4,914,562 A * 4/1990 Abe et al. ..... 347/63
5,701,148 A 12/1997 Moynihan et al. ..... 347/92
6,074,033 A 6/2000 Sayama et al.
6,074,040 A * 6/2000 Usui et al. ..... 347/45
6,345,880 B1 * 2/2002 DeBoer et al. ..... 347/45

(Continued)

FOREIGN PATENT DOCUMENTS

EP 0 321 075 A2 6/1989

(Continued)

OTHER PUBLICATIONS

Patent Abstracts of Japan, vol. 014, No. 147 (M-0952), Mar. 20, 1990 (& JP 02-011331 (Jan. 16, 1990).

(Continued)

*Primary Examiner*—Matthew Luu
*Assistant Examiner*—Lisa M Solomon
(74) *Attorney, Agent, or Firm*—Lee & Morse, P.C.

(57) ABSTRACT

In a piezoelectric ink-jet printhead, and a method of manufacturing a nozzle plate, the piezoelectric ink-jet printhead includes a flow path plate having an ink flow path including pressure chambers to be filled with ink to be ejected, a piezoelectric actuator formed on an upper surface of the flow path plate and for supplying a driving force for ink ejection to the pressure chambers, and a nozzle plate bonded to a lower surface of the flow path plate including nozzles for ejecting ink from the pressure chambers bored through the nozzle plate. The printhead may further include a heater formed on a lower surface of the nozzle plate for heating ink in the ink flow path and/or a temperature detector formed on a lower surface of the nozzle plate or on an upper surface of the flow path plate.

33 Claims, 11 Drawing Sheets

U.S. PATENT DOCUMENTS

| | | | | |
|---|---|---|---|---|
| 6,523,943 | B1 * | 2/2003 | Fukui | 347/68 |
| 2002/0001015 | A1 | 1/2002 | Kojima et al. | |
| 2002/0102792 | A1 * | 8/2002 | Kwak et al. | 438/255 |
| 2003/0081064 | A1 | 5/2003 | Dante et al. | |

FOREIGN PATENT DOCUMENTS

| | | | |
|---|---|---|---|
| EP | 0 321 075 | A3 | 6/1989 |
| EP | 0 609 011 | A2 | 8/1994 |
| EP | 0 609 011 | A3 | 8/1994 |
| EP | 0 900 657 | A2 | 3/1999 |
| EP | 0 900 657 | A3 | 3/1999 |
| EP | 1 413 438 | A1 | 4/2004 |

OTHER PUBLICATIONS

Patent Abstracts of Japan, vol. 017, No. 186 (M-1395), Apr. 12, 1993 (& JP 04 338546 (Nov. 25, 1992).

* cited by examiner

PIEZOELECTRIC INK-JET PRINTHEAD AND METHOD OF MANUFACTURING A NOZZLE PLATE OF THE SAME

BACKGROUND OF THE INVENTION

1. Field of the Invention

The present invention relates to a piezoelectric ink-jet printhead. More particularly, the present invention relates to a piezoelectric ink-jet printhead including a nozzle plate integrally formed with a heater for heating ink and a method of manufacturing the nozzle plate.

2. Description of the Related Art

Generally, an ink-jet printhead is a device that ejects small volume ink droplets at desired positions on a recording medium, thereby printing a desired color image. Ink-jet printheads are generally categorized into two types depending on which ink ejection mechanism is used. A first type is a thermal ink-jet printhead, in which ink is heated to form ink bubbles and the expansive force of the bubbles causes ink droplets to be ejected. A second type is a piezoelectric ink-jet printhead, in which a piezoelectric crystal is deformed to exert pressure on ink causing ink droplets to be ejected.

FIG. 1A illustrates a plan view of a conventional piezoelectric ink-jet printhead. FIG. 1B illustrates a vertical cross-sectional view taken along line I-I' of FIG. 1A.

Referring to FIGS. 1A and 1B, a flow path plate 10 having ink flow paths including a manifold 13, a plurality of restrictors 12, and a plurality of pressure chambers 11 is formed. A nozzle plate 20 having a plurality of nozzles 22 at positions corresponding to the respective pressure chambers 11 is formed on a lower surface of the flow path plate 10. A piezoelectric actuator 40 is disposed on an upper surface of the flow path plate 10. The manifold 13 is a common passage through which ink from an ink reservoir (not shown) is introduced into each of the plurality of pressure chambers 11. Each of the plurality of restrictors 12 is an individual passage through which ink from the manifold 13 is introduced into a respective pressure chamber 11. Each of the plurality of pressure chambers 11 is filled with ink to be ejected and collectively they may be disposed at one or both sides of the manifold 13. Volumes of each of the plurality of pressure chambers 11 change according to the driving of the piezoelectric actuator 40, thereby generating a change of pressure to perform ink ejection or introduction. To generate this change in pressure, an upper wall of each pressure chamber 11 of the flow path plate 10 serves as a vibrating plate 14 that can be deformed by the piezoelectric actuator 40.

The piezoelectric actuator 40 includes a lower electrode 41, piezoelectric layers 42, and upper electrodes 43, which are sequentially stacked on the flow path plate 10. A silicon oxide layer 31 is formed as an insulating film between the lower electrode 41 and the flow path plate 10. The lower electrode 41 is formed on the entire surface of the silicon oxide layer 31 and serves as a common electrode. The piezoelectric layers 42 are formed on the lower electrode 41 and are positioned on an upper surface of each of the pressure chambers 11. The upper electrodes 43 are formed on the piezoelectric layers 42 and serve as driving electrodes for applying a voltage to the piezoelectric layers 42.

To apply a driving voltage to the piezoelectric actuator 40 having the above-described structure, a flexible printed circuit (FPC) 50 for voltage application is connected to the upper electrodes 43. More specifically, driving signal lines 51 of the flexible printed circuit 50 are disposed on the upper electrodes 43 and then are heated and pressurized to bond the driving signal lines 51 to upper surfaces of the upper electrodes 43.

However, when the above-described conventional ink-jet printhead is used to eject high viscosity ink, flow resistance increases due to the high ink viscosity, thereby decreasing the ejection volume and ejection speed of ink droplets. Therefore, overall ink ejection performance is lowered, which renders printing quality unsatisfactory. In this respect, to ensure satisfactory ejection performance for high viscosity ink, reduction of ink viscosity by heating the ink with a heater is required.

For example, one conventional ink-jet printhead includes an ink cartridge in which a heater for heating ink is mounted outside the ink-jet printhead. In this conventional ink cartridge, however, since the heater is located relatively far from a nozzle plate, a temperature profile relative to the location on the nozzle plate heated by the heater is not uniform. Therefore, ink temperatures of nozzles arranged in the nozzle plate is also non-uniform, thereby causing a variation of the ejection speed and volume of ink droplets through the nozzles. Furthermore, the heater separately mounted outside the ink-jet printhead increases the complexity and size of the ink cartridge.

When ink is heated using a heater as described above, ink temperature detection for controlling an ink temperature is required. One such conventional method includes a technique of controlling printing quality by detecting an ambient temperature using a thermistor and estimating physical properties of ink from the detection result. However, this technique has a disadvantage in that an ink temperature value estimated from a detected ambient temperature may vary depending on operating conditions of a printhead.

SUMMARY OF THE INVENTION

The present invention is therefore directed to a piezoelectric ink-jet printhead and a method of manufacturing a nozzle plate of the same, which substantially overcome one or more of the problems due to the limitations and disadvantages of the related art.

It is a feature of an embodiment of the present invention to provide a piezoelectric ink-jet printhead having a simplified structure including a nozzle plate integrally formed with a heater for heating ink that is capable of heating ink to a uniform temperature.

It is another feature of an embodiment of the present invention to provide a method of manufacturing the nozzle plate of the piezoelectric ink-jet printhead.

At least one of the above and other features and advantages of the present invention may be realized by providing a piezoelectric ink-jet printhead including a flow path plate having an ink flow path including a plurality of pressure chambers to be filled with ink to be ejected, a piezoelectric actuator formed on an upper surface of the flow path plate and for supplying a driving force for ink ejection to the plurality of pressure chambers, a nozzle plate bonded to a lower surface of the flow path plate including a plurality of nozzles for ejecting ink from the plurality of pressure chambers bored through the nozzle plate, and a heater formed on a lower surface of the nozzle plate for heating ink in the ink flow path.

The piezoelectric ink-jet printhead may further include an insulating layer formed on a lower surface of the nozzle plate, the heater being formed in a predetermined pattern on a surface of the insulating layer, and a protection layer for protecting the heater formed on the insulating layer and the heater. Each of the insulating layer and the protection layer may be a silicon oxide layer.

The piezoelectric ink-jet printhead may further include bonding pads for bonding a power supply line formed at ends of the heater, and contact holes through the protection layer for exposing the bonding pads.

The piezoelectric ink-jet printhead may further include a temperature detector for detecting a temperature of ink in the ink flow path. The temperature detector may be formed of a metal material having a variable resistance with respect to temperature. The temperature detector may be formed on a lower surface of the nozzle plate concurrently with the heater. The heater and the temperature detector may be formed of a same metal material. The heater and the temperature detector may be formed of platinum (Pt).

The piezoelectric ink-jet printhead may further include bonding pads for bonding a temperature detection signal line formed at ends of the temperature detector.

The temperature detector may be formed on an upper surface of the flow path plate concurrently with the piezoelectric actuator. The piezoelectric actuator may include a lower electrode and the temperature detector may be formed on a same plane using a same metal material as the lower electrode of the piezoelectric actuator. The temperature detector and the lower electrode may be formed of platinum (Pt). The temperature detector may be bounded by a trench extending through the lower electrode and may be insulated from the lower electrode by the trench.

The piezoelectric ink-jet printhead may further include a connection electrode for connecting the temperature detection signal line to the temperature detector, and a dummy piezoelectric layer for supporting the connection electrode, the connection electrode and the dummy piezoelectric layer being formed on the lower electrode.

The piezoelectric ink-jet printhead may further include nozzle metal layers formed around the nozzles on a lower surface of the nozzle plate. The nozzle metal layers may have a circular ring shape. The heater and the nozzle metal layers may be formed on a same plane using a same metal material. The heater and the nozzle metal layers may be formed of platinum (Pt). The piezoelectric ink-jet printhead may further include the temperature detector and the nozzle metal layers.

The piezoelectric ink-jet printhead may further include hydrophobic plating layers formed on the nozzle metal layers. The hydrophobic plating layers may be formed of gold (Au).

At least one of the above and other features and advantages of the present invention may be realized by providing a piezoelectric ink-jet printhead including a flow path plate having an ink flow path including a plurality of pressure chambers to be filled with ink to be ejected, a piezoelectric actuator for supplying a driving force for ink ejection to the plurality of pressure chambers, a nozzle plate bonded to a lower surface of the flow path plate including a plurality of nozzles for ejecting ink from the plurality of pressure chambers bored through the nozzle plate, and a temperature detector for detecting a temperature of ink in the ink flow path.

The piezoelectric actuator may further include a lower electrode formed on an upper surface of the flow path plate, a piezoelectric layer formed on the lower electrode, and an upper electrode formed on the piezoelectric layer, and the temperature detector may be formed on the upper surface of the flow path plate concurrently with the piezoelectric actuator.

The temperature detector may be formed on a same plane as the lower electrode of the piezoelectric actuator and is formed of a metal material having a variable resistance with respect to temperature. The temperature detector and the lower electrode may be formed of platinum (Pt).

The temperature detector may be bounded by a trench extending through the lower electrode and may be insulated from the lower electrode by the trench.

The piezoelectric ink-jet printhead may further include a connection electrode for connecting a temperature detection signal line to the temperature detector, and a dummy piezoelectric layer for supporting the connection electrode, the connection electrode and the dummy piezoelectric layer being formed on the lower electrode.

The dummy piezoelectric layer may be disposed in parallel to the piezoelectric layer on the lower electrode and an end of the dummy piezoelectric layer may extend onto the temperature detector, and wherein the connection electrode may be formed on an upper surface of the dummy piezoelectric layer and an end of the connection electrode may extend beyond the end of the dummy piezoelectric layer and contacts an upper surface of the temperature detector.

A height of the dummy piezoelectric layer may be the same as a height of the piezoelectric layer.

At least one of the above and other features and advantages of the present invention may be realized by providing a method of manufacturing a nozzle plate of a piezoelectric ink-jet printhead, the nozzle plate including a plurality of nozzles for ejecting ink bored through the nozzle plate, the method including preparing a silicon substrate, forming ink guiding portions of each of the plurality of nozzles by partially etching an upper surface of the silicon substrate, coating a photoresist on a lower surface of the silicon substrate and patterning the photoresist, forming a metal layer on the lower surface of the silicon substrate and a surface of the patterned photoresist, lifting-off the patterned photoresist and removing the metal layer formed on the surface of the patterned photoresist to form a heater from a residual metal layer, forming a protection layer for protecting the heater on the lower surface of the silicon substrate, and forming openings by partially etching the protection layer and forming ink outlets in communication with the ink guiding portions by etching portions of the silicon substrate exposed through the openings.

The method may further include forming insulating layers on lower and upper surfaces of the silicon substrate, prior to forming the ink guiding portions. The insulating layers may be silicon oxide layers.

The metal layer may be formed of platinum (Pt).

Lifting-off the patterned photoresist and removing the metal layer formed on the surface of the patterned photoresist to form the heater from the residual metal layer may further include forming a temperature detector for detecting ink temperature from the residual metal layer, in addition to forming the heater.

Lifting-off the patterned photoresist and removing the metal layer formed on the surface of the patterned photoresist to form a heater from a residual metal layer may further include forming nozzle metal layers surrounding the nozzles from the residual metal layer, in addition to forming the heater.

Lifting-off the patterned photoresist and removing the metal layer formed on the surface of the patterned photoresist to form a heater from a residual metal layer may further include forming a temperature detector for detecting ink temperature and nozzle metal layers surrounding the nozzles from the residual metal layer, in addition to forming the heater.

Forming openings by partially etching the protection layer and forming ink outlets in communication with the ink guiding portions by etching portions of the silicon substrate exposed through the openings may further include exposing the nozzle metal layers through the openings and using the nozzle metal layers as etching masks for etching the silicon substrate.

The method may further include forming hydrophobic plating layers on the nozzle metal layers, after forming the openings and the ink outlets. Forming the hydrophobic plating layers may include performing electroplating using the nozzle metal layers as seed layers. The hydrophobic plating layers may be formed of gold (Au).

Forming openings by partially etching the protection layer and forming ink outlets in communication with the ink guiding portions by etching portions of the silicon substrate exposed through the openings may further include using a patterned dry film photoresist as an etching mask for etching the protection layer.

The method may further include forming contact holes exposing bonding pads formed at ends of the heater by partially etching the protection layer after forming the openings and the ink outlets.

According to the embodiments of the present invention, since a printhead has an integrally formed structure of a heater for heating ink and a nozzle plate, it is easier to manufacture and is able to heat ink therein to a uniform temperature.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF THE INVENTION

Figure 1A:
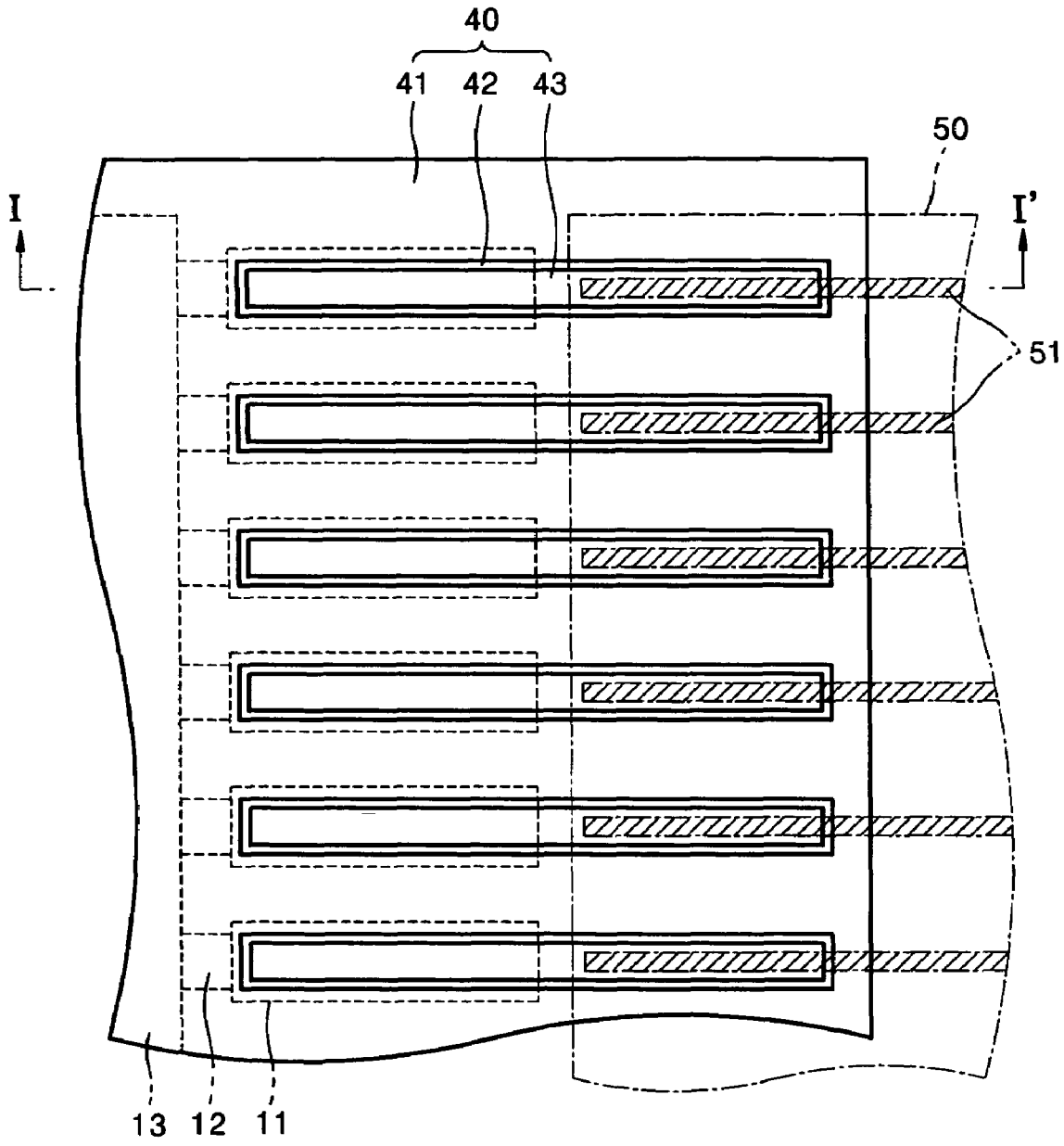
FIG. 1A (PRIOR ART)
FIG. 1A illustrates a plan view of a conventional piezoelectric ink-jet printhead and FIG. 1B illustrates a vertical cross-sectional view taken along line I-I' of FIG. 1A.
Figure 1B:
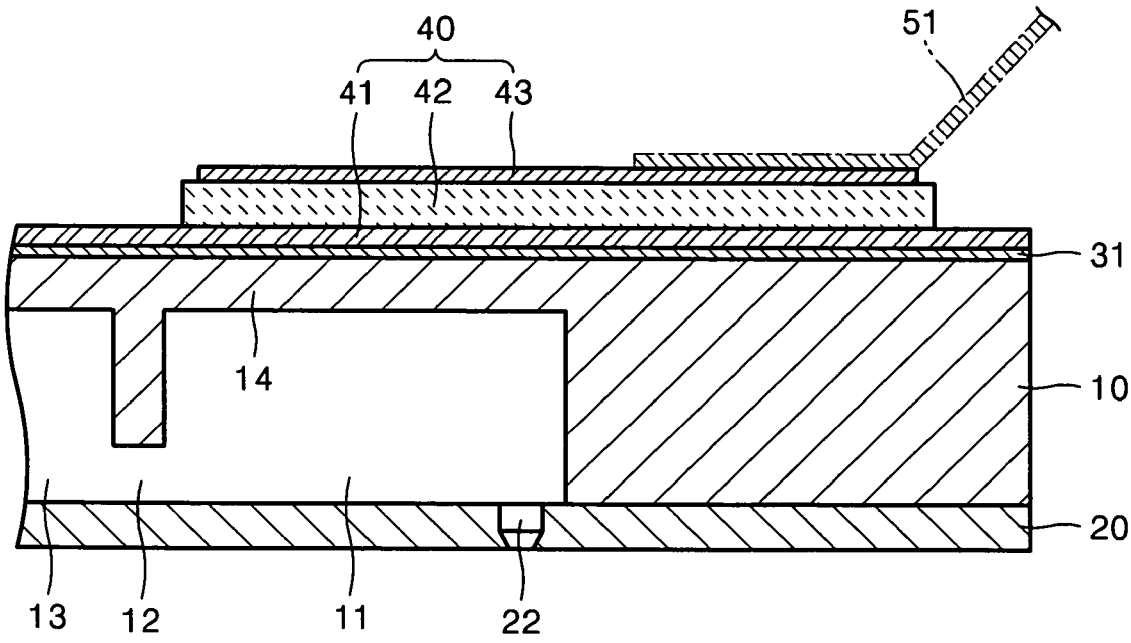
FIG. 1B (PRIOR ART)

Korean Patent Application No. 10-2004-0013567, filed on Feb. 27, 2004, in the Korean Intellectual Property Office, and entitled: "Piezoelectric Ink-jet Printhead and Method of Manufacturing a Nozzle Plate," is incorporated by reference herein in its entirety.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the figures, the dimensions of elements, layers and regions are exaggerated for clarity of illustration. It will also be understood that when a layer is referred to as being "on" another layer or substrate, it can be directly on the other layer or substrate, or intervening layers may also be present. Further, it will be understood that when a layer is referred to as being "between" two layers, it can be the only layer between the two layers, or one or more intervening layers may also be present. Like reference numerals refer to like elements throughout.

Figure 2:
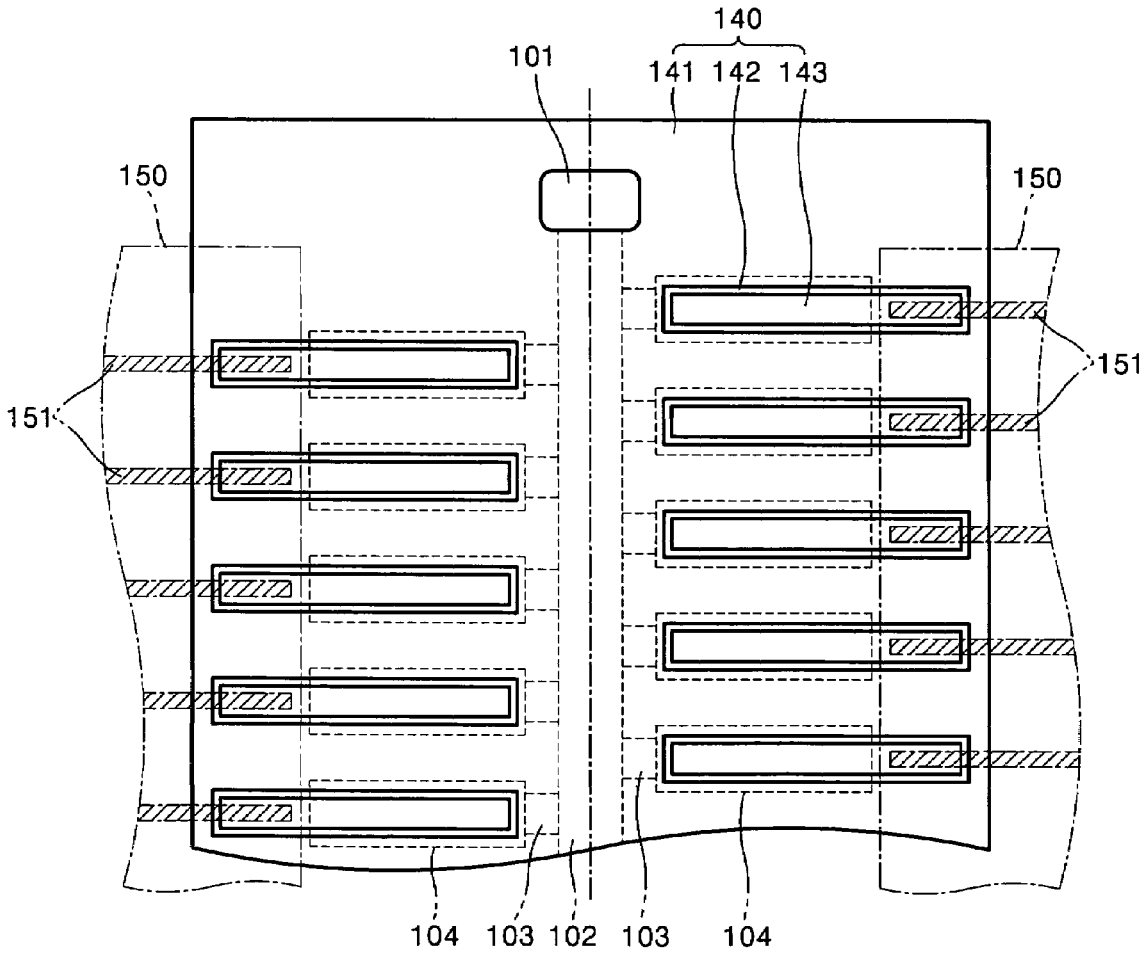
FIG. 2 illustrates a top plan view of a piezoelectric ink-jet printhead according to a first embodiment of the present invention.
Figure 3:
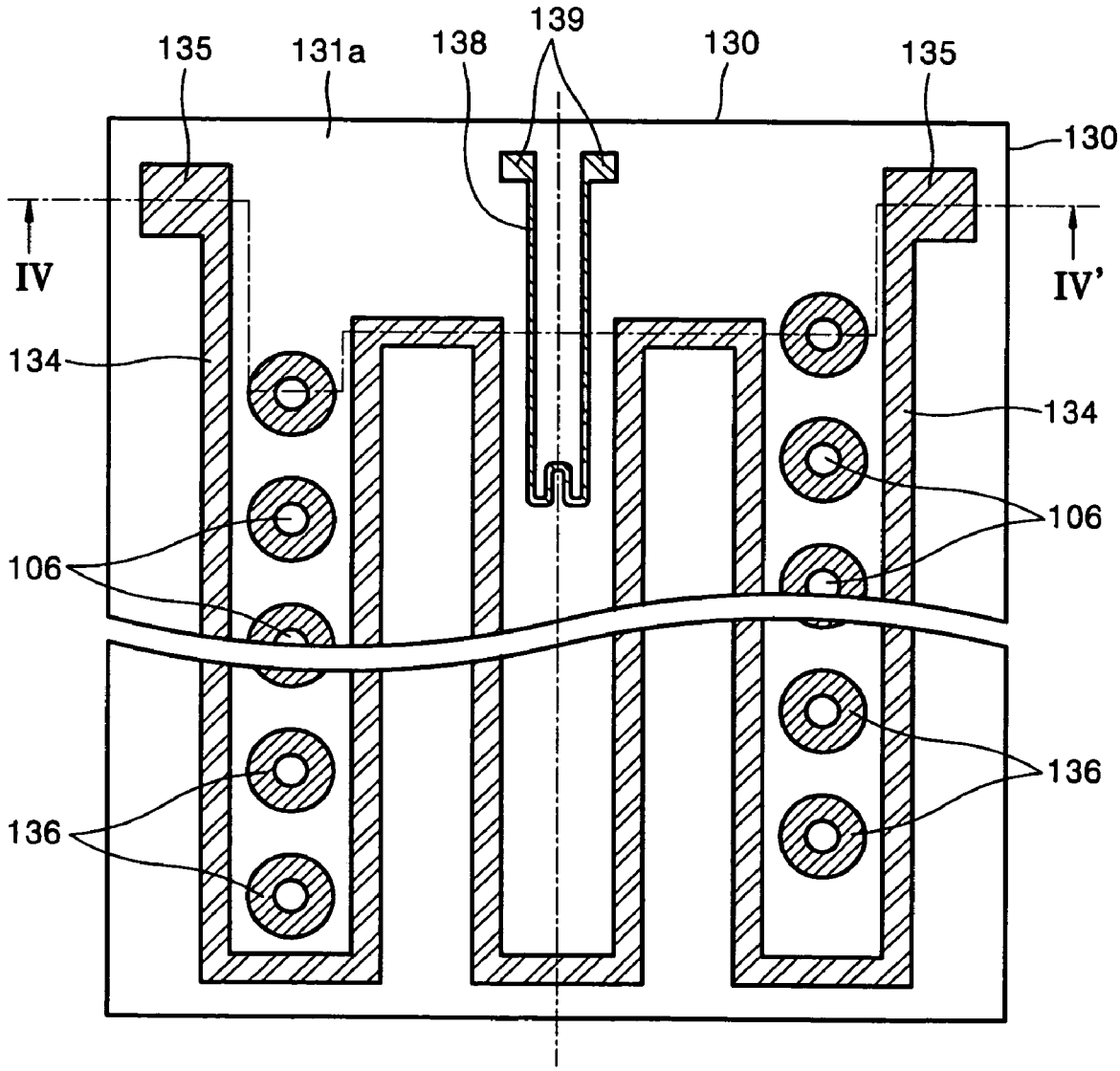
FIG. 3 illustrates a bottom plan view of a nozzle plate of the ink-jet printhead of FIG. 2.
Figure 4:
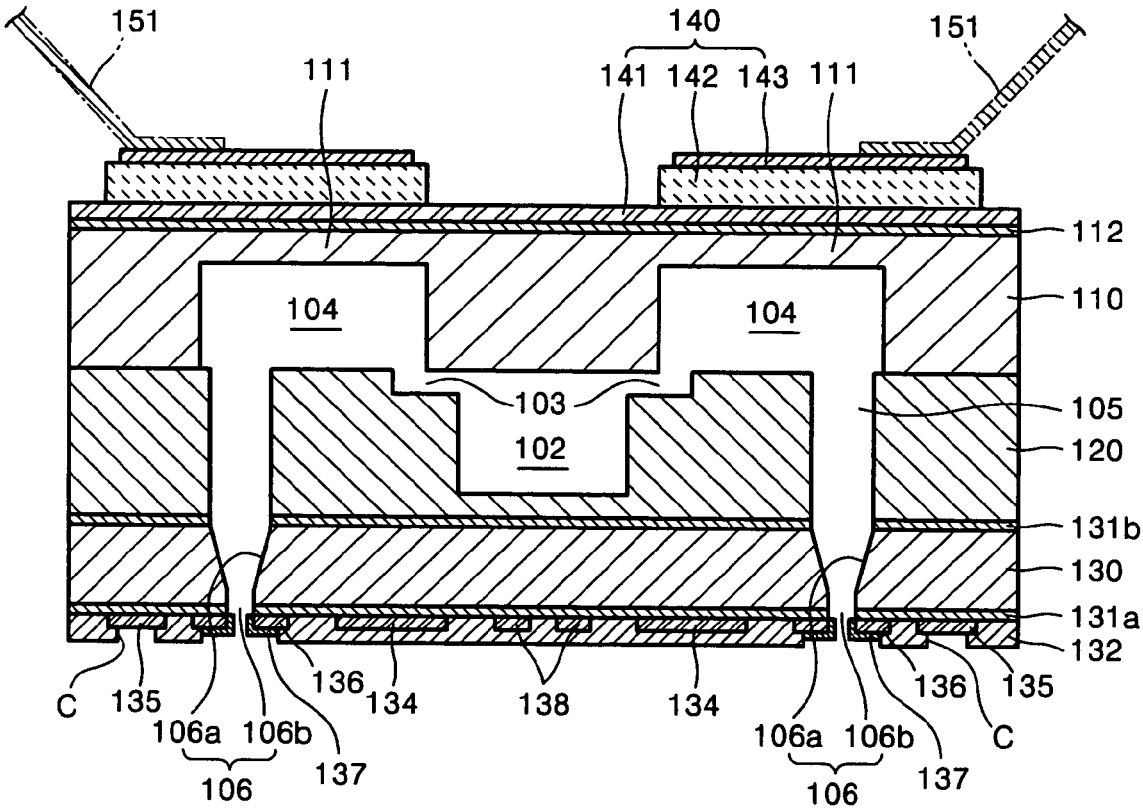
FIG. 4 illustrates a vertical cross-sectional view taken along line IV-IV' of FIG. 3.

FIG. 2 illustrates a top plan view of a piezoelectric ink-jet printhead according to a first embodiment of the present invention. FIG. 3 illustrates a bottom plan view of a nozzle plate of the ink-jet printhead of FIG. 2. FIG. 4 illustrates a vertical sectional view taken along line IV-IV' of FIG. 3.

Referring to FIGS. 2 through 4, the piezoelectric ink-jet printhead according to the first embodiment of the present invention includes a flow path plate having an ink flow path including pressure chambers 104, a nozzle plate 130, through which nozzles 106 for ink ejection are bored, a piezoelectric actuator 140 disposed on the flow path plate for supplying a driving force for ink ejection to the pressure chambers 104, and a heater 134 for heating ink integrally formed on a lower surface of the nozzle plate 130.

The ink flow path includes the pressure chambers 104, which are to be filled with ink to be ejected, capable of generating a change of pressure for ink ejection, an ink inlet 101 for introducing ink from an ink reservoir (not shown), a manifold 102, which is a common flow path for ink introduction from the ink inlet 101 into each of the pressure chambers 104, and restrictors 103, which are individual flow paths for introducing ink from the manifold 102 into each pressure chamber 104. Further, dampers 105 may be provided between the pressure chambers 104 and the nozzles 106 formed in the nozzle plate 130 to concentrate energy generated in the pressure chambers 104 by the piezoelectric actuator 140 toward the nozzles 106 and to prevent a rapid pressure change. The above elements of the ink flow path are formed in the flow path plate. Vibrating plates 111 that can be deformed as the piezoelectric actuator 140 is driven are disposed at upper surfaces of the pressure chambers 104.

More specifically, the flow path plate may include a first flow path plate 110 and a second flow path plate 120, as shown in FIG. 4. In this case, the pressure chambers 104 are formed to a predetermined depth from a lower surface of the first flow path plate 110 and the ink inlet 101 is bored through one side of the first flow path plate 110. The pressure chambers 104 have a cuboidal shape, which is longer along an ink flow direction, and are arranged in two arrays at both sides of the manifold 102 formed in the second flow path plate 120. Alternatively, the pressure chambers 104 may be arranged in a single array at one side of the manifold 102.

As described above, the second flow path plate 120 includes the manifold 102. An end of the manifold 102 is connected to the ink inlet 101. The manifold 102 may be formed to a predetermined depth from an upper surface of the second flow path plate 120, as shown in FIG. 4. Alternatively, the manifold 102 may be vertically bored through the second flow path plate 120. The second flow path plate 120 also includes the restrictors 103, which are individual flow paths for providing communication between the manifold 102 and an end of respective pressure chambers 104. Like the manifold 102, the restrictors 103 may be formed to a predetermined depth from an upper surface of the second flow path plate 120, as shown in FIG. 4, or may be vertically bored through the second flow path plate 120. The dampers 105 for providing communication between the pressure chambers 104 and the nozzles 106 are bored through the second flow path plate 120 at positions corresponding to an opposite end of each pressure chamber 104 from the end connected to the restrictors 103.

Even though in the present embodiment, the elements of the ink flow path are exemplarily arranged in two flow path plates 110 and 120, this arrangement has been provided only for purposes of illustration. For example, the elements of the ink flow path may have different arrangements in a piezoelectric ink-jet printhead according to an embodiment of the present invention. These elements of the ink flow path may also be arranged in only a single plate or in three or more plates, instead of the two flow path plates 110 and 120, as exemplarily illustrated.

The piezoelectric actuator 140 is formed on an upper surface of the first flow path plate 110 at a position corresponding to each pressure chamber 104 to supply a driving force for ink ejection to the pressure chambers 104. The piezoelectric actuator 140 includes a lower electrode 141 used as a common electrode, piezoelectric layers 142 that are deformed by an applied voltage, and upper electrodes 143 used as driving electrodes. The piezoelectric actuator 140 has a sequentially stacked structure of the lower electrode 141, the piezoelectric layers 142, and the upper electrodes 143 on the first flow path plate 110.

A first insulating layer 112 may be formed between the lower electrode 141 and the first flow path plate 110. The lower electrode 141 is formed on the entire surface of the first insulating layer 112 and may be a single conductive material layer, e.g., metal. However, it is preferable to form a thin metal bi-layer composed of a titanium (Ti) layer and a platinum (Pt) layer as the lower electrode 141. The lower electrode 141, when formed of Ti/Pt, serves as a common electrode, and at the same time, as a diffusion barrier layer for preventing inter-diffusion between the underlying first flow path plate 110 and the overlying piezoelectric layers 142. The piezoelectric layers 142 are disposed on the lower electrode 141 at positions corresponding to the pressure chambers 104. The piezoelectric layers 142 are deformed by an applied voltage, thereby causing bending of the vibrating plates 111 at upper surfaces of the pressure chambers 104. The piezoelectric layers 142 may be formed of a piezoelectric material, and may preferably be a lead zirconate titanate (PZT) ceramic material. The upper electrodes 143 serve as driving electrodes for applying a voltage to the piezoelectric layers 142 and are formed on the piezoelectric layers 142.

To apply a driving voltage to the piezoelectric actuator 140 of the above-described structure, a driving circuit for voltage application, e.g., a flexible printed circuit (FPC) 150 is connected to the upper electrodes 143. More specifically, when driving signal lines 151 of the flexible printed circuit 150 disposed on the upper electrodes 143 are heated and pressurized, the driving signal lines 151 are bonded to upper surfaces of the upper electrodes 143.

The nozzle plate 130 is bonded to a lower surface of the second flow path plate 120. The bonding between the nozzle plate 130 and the second flow path plate 120 may be performed by a known silicon direct bonding (SDB) method. The nozzles 106 are bored through the nozzle plate 130 at positions corresponding to the dampers 105. The nozzles 106 include ink outlets **106*b* for ejecting ink formed at a lower surface of the nozzle plate 130 and ink guiding portions 106*a*, formed at an upper surface of the nozzle plate 130, for providing communication between the dampers 105 and the ink outlets 106*b* and for guiding ink from the dampers 105 toward the ink outlets 106*b*. The ink outlets 106*b* may be formed as vertical holes of a predetermined diameter. The ink guiding portions 106*a* may be formed in a square pyramidal shape having a decreasing sectional area from the dampers 105 to the ink outlets 106*b*. Lower and upper second insulating layers 131*a* and 131*b*, e.g., first silicon oxide layers, are disposed on lower and upper surfaces, respectively, of the nozzle plate 130, through which the nozzles 106** are bored.

The nozzle plate 130 is integrally formed with the heater 134 for heating ink. More specifically, the heater 134 is formed on a surface of the lower first silicon oxide layer **131*a* covering a lower surface of the nozzle plate 130. The lower first silicon oxide layer 131*a* serves as an insulating film for insulating the nozzle plate 130 from the heater 134. The heater 134 may be formed of a resistive heating metal material, e.g., platinum (Pt). It is particularly preferable that the heater 134 be formed of Pt so that a temperature detector 138, which will be described later, can be formed of the same material as the heater 134**.

The heater 134 may be formed in a pattern, as shown in FIG. 3, so that it is uniformly arranged over an entire lower surface of the lower first silicon oxide layer **131*a*. However, the heater 134 may also be formed in any pattern that can uniformly heat the entire surface of the nozzle plate 130, instead of the pattern shown in FIG. 3. Bonding pads 135 are disposed at both ends of the heater 134 to bond a power supply line (not shown) for supplying power to the heater 134**.

As described above, according to the first embodiment of the present invention, the nozzle plate 130 is integrally formed with the heater 134 for heating ink, which simplifies the construction of an ink-jet printhead and decreases a manufacturing cost as compared to a conventional technique. Furthermore, since the heater 134 is uniformly arranged throughout the lower surface of the nozzle plate 130, ink inside the printhead, i.e., inside the ink flow path, can be heated more uniformly. Therefore, ejection speed and volume of ink droplets through the nozzles 106 can be uniformly maintained, thereby enhancing printing quality.

The nozzle plate 130 may be formed with the temperature detector 138 to detect the temperature of ink inside the ink flow path. More specifically, the temperature detector 138 may be formed on a surface of the lower first silicon oxide layer **131*a* on the lower surface of the nozzle plate 130, concurrently with the heater 134. The temperature detector 138 is formed of a metal that has an electrical resistance varying with temperature. This metal may be any metal known in the art. However, as describe above, it is preferable to use Pt since both the temperature detector 138 and the heater 134** can be formed of Pt.

The temperature detector 138 is formed on a surface portion of the lower first silicon oxide layer **131*a* to be insulated from the heater 134, as shown in FIG. 3. Bonding pads 139 are disposed at both ends of the temperature detector 138** to bond a temperature detection signal line (not shown).

As described above, the temperature detector 138 for detecting ink temperature is integrally formed with the nozzle plate 130. Therefore, ink temperature can be more accurately detected, and thus, an active and accurate temperature control with respect to change of ink temperature is possible, thereby enhancing printing quality.

The nozzle plate 130 may also be formed to include nozzle metal layers 136 surrounding orifices of the nozzles 106. The nozzle metal layers 136 may be formed in a circular ring shape on a surface of the lower first silicon oxide layer **131*a* around the orifices of the nozzles 106, as shown in FIG. 3. The nozzle metal layers 136 may be formed of a same material as the heater 134 and the temperature detector 138. Use of a common material is advantageous because it allows the nozzle metal layers 136 to be formed simultaneously with the heater 134 and the temperature detector 138. These nozzle metal layers 136 serve as etching masks for formation of the ink outlets 106*b* of the nozzles 106 in a nozzle plate manufacturing method as will be described later, which ensures accurate and easy formation of the ink outlets 106*b***.

The nozzle metal layers 136 may have a hydrophobic property according to a material. Further, to make the nozzles 106 more hydrophobic, as shown in FIG. 4, hydrophobic plating layers 137 may be formed on surfaces of the nozzle metal layers 136 using a good hydrophobic metal material, e.g., gold (Au). In this case, as will be described later, the nozzle metal layers 136 serve as seed layers in the formation of the hydrophobic plating layers 137 by electroplating, which ensures easy formation of the hydrophobic plating layers 137.

When the nozzle metal layers 136 and the hydrophobic plating layers 137 are formed around the orifices of the nozzles 106, ink to be ejected through the nozzles 106 can form virtually perfect ink droplets, thereby enhancing directionality of ink droplets and printing quality. Furthermore, since a meniscus created in each of the nozzles 106 after ink ejection is rapidly stabilized, introduction of ambient air into the pressure chambers 104 and contamination of the nozzles 106 by ink can be prevented.

A protection layer 132, e.g., a second silicon oxide layer, may be formed on a surface of the lower first silicon oxide layer 131*a* on a lower surface of the nozzle plate 130 and a surface of the heater 134 and the temperature detector 138. The second silicon oxide layer 132 is formed with contact holes C to expose the bonding pads 135 of the heater 134 and the bonding pads 139 of the temperature detector 138.

Figure 5:
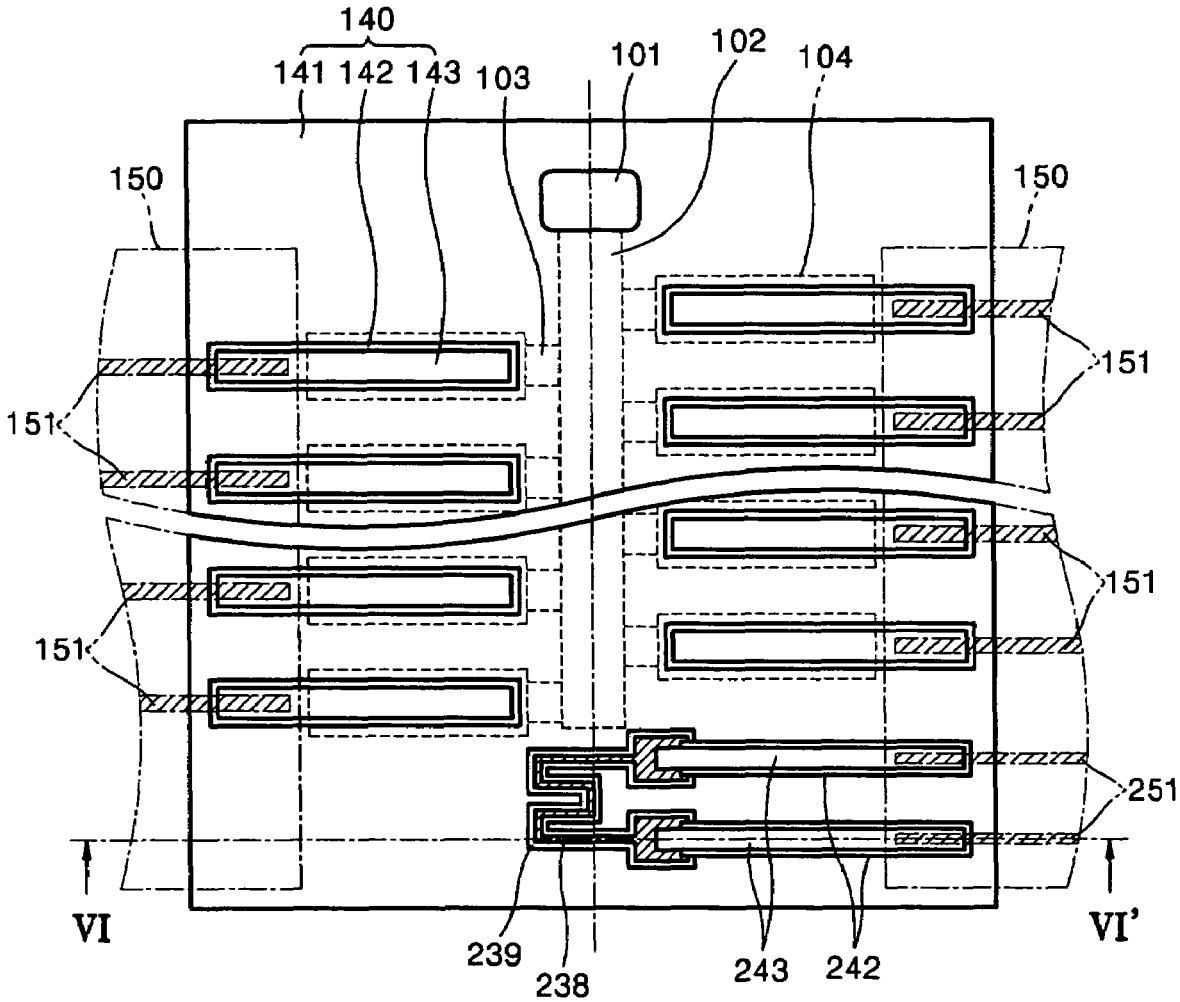
FIG. 5 illustrates a top plan view of a piezoelectric ink-jet printhead according to a second embodiment of the present invention.
Figure 6:
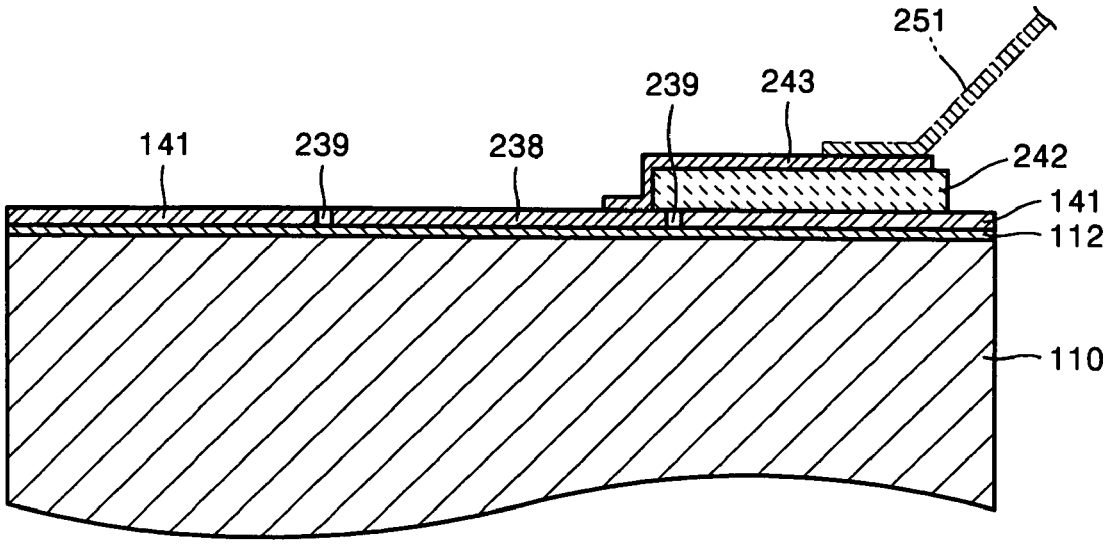
FIG. 6 illustrates a partial vertical cross-sectional view taken along line VI-VI' of FIG. 5.

FIG. 5 illustrates a top plan view of a piezoelectric ink-jet printhead according to a second embodiment of the present invention. FIG. 6 illustrates a partial vertical cross-sectional view taken along line VI-VI' of FIG. 5. The ink-jet printhead according to the second embodiment is substantially the same as in the first embodiment except that a temperature detector is disposed on an upper surface of a flow path plate, as opposed to on the nozzle plate. In this respect, descriptions of elements common to the first embodiment will be omitted or only briefly provided.

Referring to FIGS. 5 and 6, in a piezoelectric ink-jet printhead according to the second embodiment, a temperature detector 238 for detecting ink temperature is formed on an upper surface of the first flow path plate 110.

More specifically, the temperature detector 238 is formed on the insulating layer 112 formed on an upper surface of the first flow path plate 110 and is insulated from the lower electrode 141 of the piezoelectric actuator 140. The temperature detector 238 may be formed of Pt, like in the first embodiment. The temperature detector 238 may be formed on a same plane using a same material as for the lower electrode 141. The temperature detector 238 is bounded by a trench 239 extending through the lower electrode 141 and is insulated from the lower electrode 141 by the trench 239.

Temperature detection signal lines 251 are electrically connected to the temperature detector 238. More specifically, the temperature detection signal lines 251 may be arranged on the flexible printed circuit 150, together with the driving signal lines 151 connected to the upper electrodes 143 of the piezoelectric actuator 140. To easily connect the temperature detection signal lines 251 to the temperature detector 238, connection electrodes 243 for connecting the temperature detection signal lines 251 to the temperature detector 238 and dummy piezoelectric layers 242 for supporting the connection electrodes 243 are arranged on the lower electrode 141. The dummy piezoelectric layers 242 are disposed in parallel with the piezoelectric layers 142 of the piezoelectric actuator 140 at one side of the first flow path plate 110. An end of each of the dummy piezoelectric layers 242 extends onto the temperature detector 238. Widths of the dummy piezoelectric layers 242 may be less than widths of the piezoelectric layers 142 of the piezoelectric actuator 140. However, it is preferable that heights of the dummy piezoelectric layers 242 are the same as heights of the piezoelectric layers 142 so that the connection electrodes 243 formed on the dummy piezoelectric layers 142 may be easily bonded to the temperature detection signal lines 251. The connection electrodes 243 are formed on upper surfaces of the dummy piezoelectric layers 242 and an end of each of the connection electrodes 243 extends beyond a corresponding end of a corresponding one of the dummy piezoelectric layers 242 and contacts an upper surface of the temperature detector 238. Therefore, an end of each of the connection electrodes 243 is electrically connected to the temperature detector 238.

As described above, according to the second embodiment of the present invention, since the temperature detector 238 for detecting ink temperature is integrally formed with the piezoelectric actuator 140 of a printhead, ink temperature can be more accurately detected. Therefore, active and accurate temperature control with respect to change of ink temperature is possible, thereby enhancing printing quality.

Hereinafter, a method of manufacturing a nozzle plate of an ink-jet printhead according to the present invention will be described with reference to FIGS. 7A through 7N.

Figure 7A:
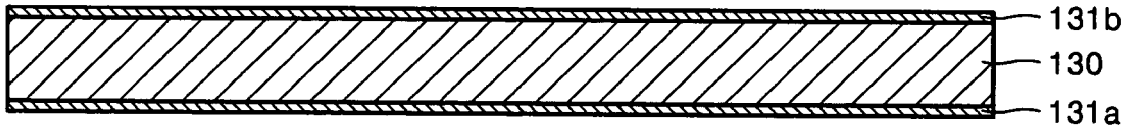
FIGS. 7A through 7N illustrate cross-sectional views of sequential stages in a method of manufacturing the nozzle plate of the piezoelectric ink-jet printhead according to the first embodiment shown in FIGS. 3 and 4.
Figure 7B:
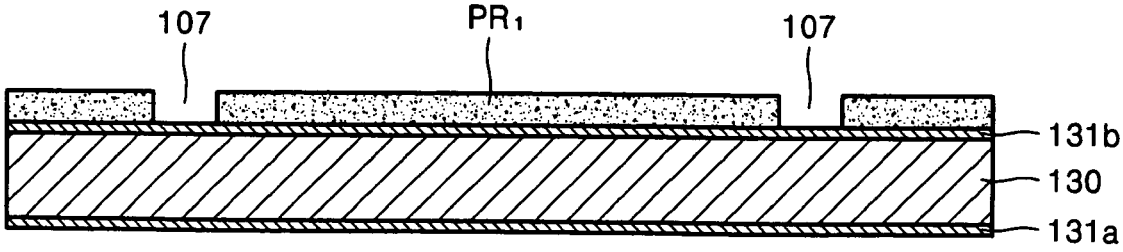
Figure 7C:
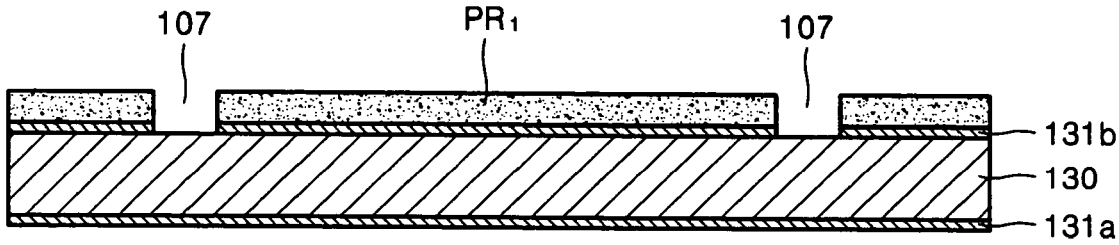
Figure 7D:
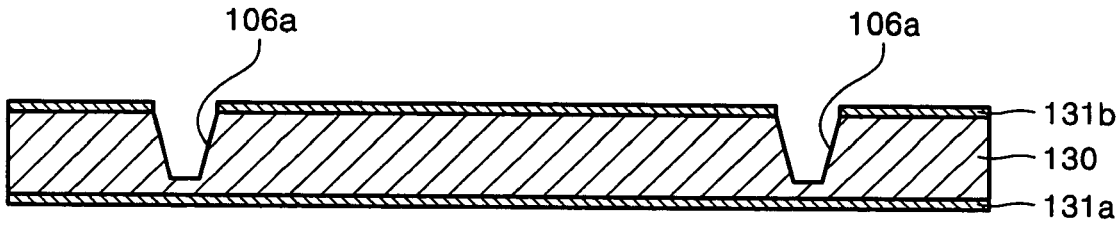
Figure 7E:
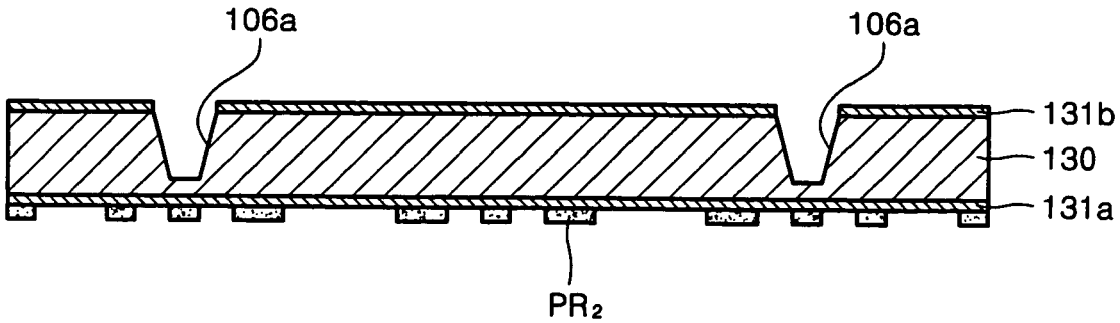
Figure 7F:
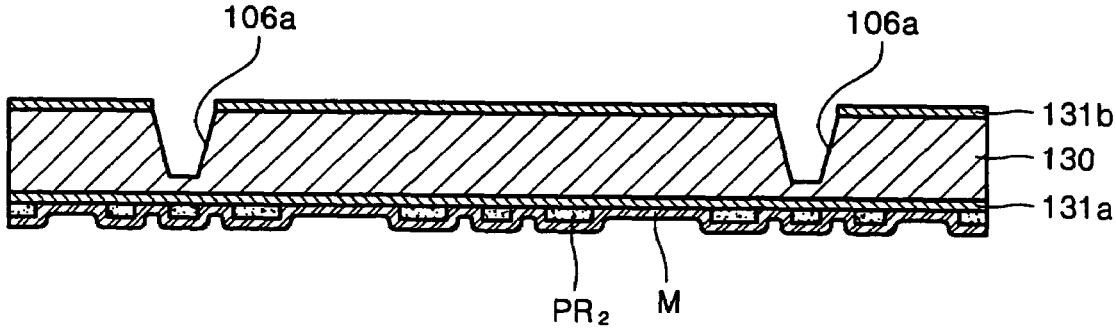
Figure 7G:
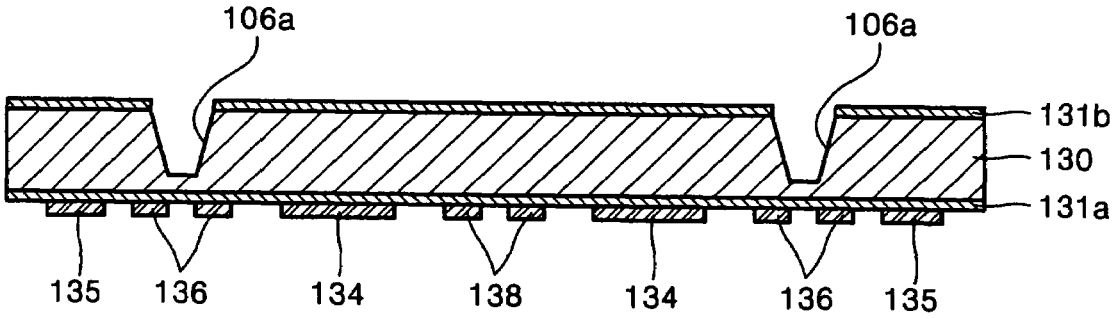
Figure 7H:
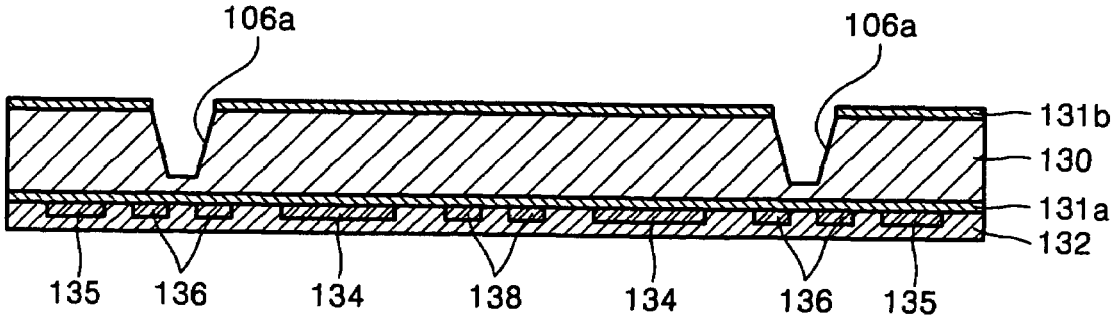
Figure 7I:
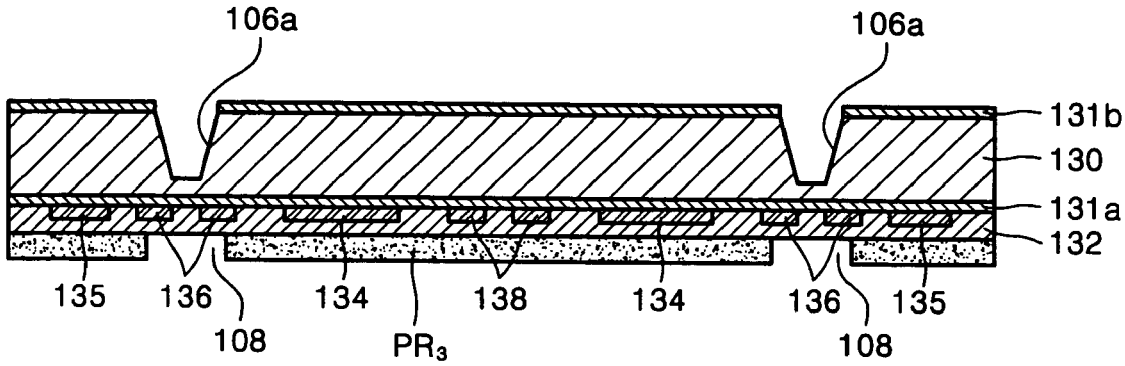
Figure 7J:
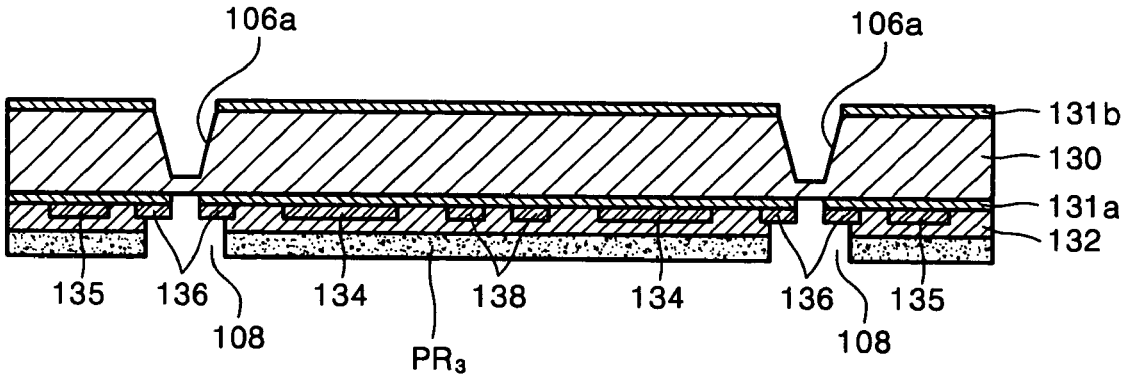
Figure 7K:
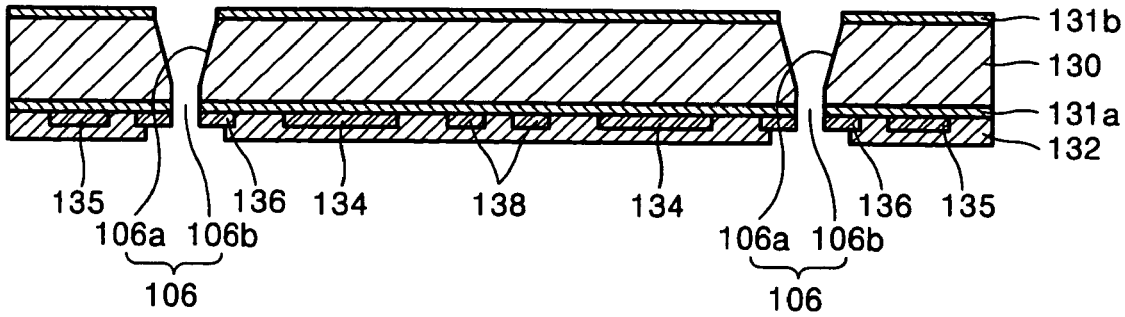
Figure 7L:
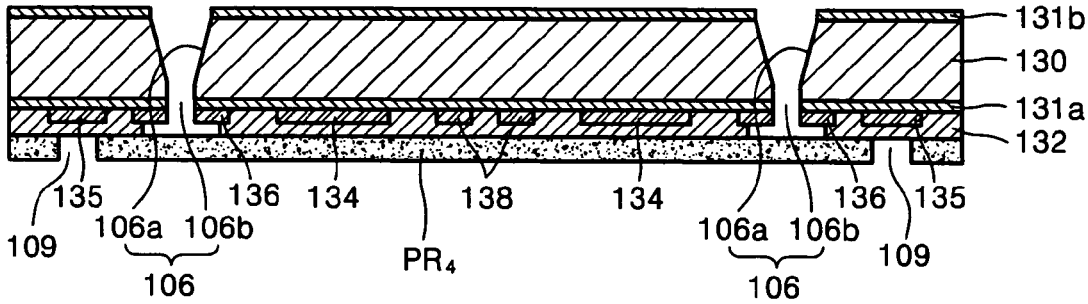
Figure 7M:
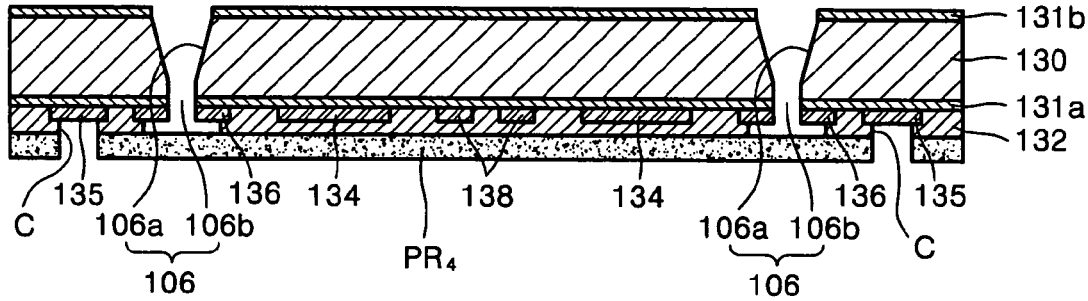
Figure 7N:
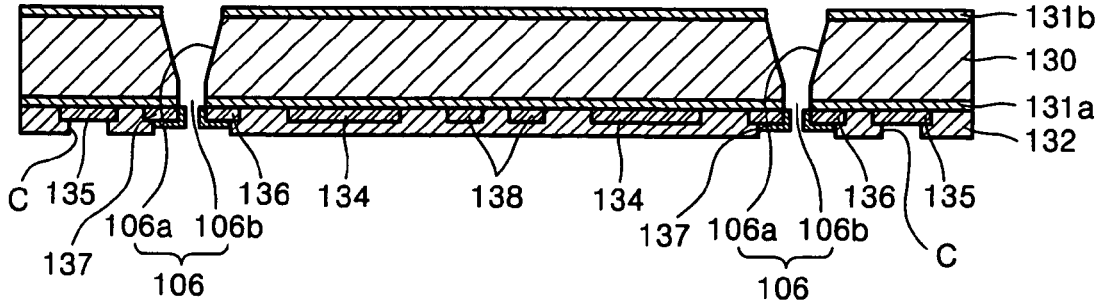

FIGS. 7A through 7N illustrate cross-sectional views of sequential stages in a method of manufacturing a nozzle plate of a piezoelectric ink-jet printhead according to the first embodiment shown in FIGS. 3 and 4. Although the following description is directed to the first embodiment, the descriptions therein are equally applicable to the second embodiment with the exception of the formation of the temperature detector.

Referring to FIG. 7A, the nozzle plate 130 may be a monocrystalline silicon substrate and may have a thickness of about 100 μm to about 200 μm, preferably about 160 μm. Throughout the following description of the method of manufacturing the nozzle plate 130, reference numeral 130 will be referred to as a silicon substrate 130 until the nozzle plate 130 is completed. When the prepared silicon substrate 130, i.e., the nozzle plate, is wet- or dry-oxidized in an oxidizing furnace, the lower and upper insulating layers 131*a* and 131*b*, e.g., first silicon oxide layers, are formed on lower and upper surfaces, respectively, of the silicon substrate 130. Alternatively, the lower and upper first silicon oxide layers 131*a* and 131*b* may be formed by chemical vapor deposition (CVD).

Referring to FIG. 7B, a first photoresist $PR_1$ is coated on an entire surface of the upper first silicon oxide layer 131*b* formed on the upper surface of the silicon substrate 130. The first photoresist $PR_1$ is then patterned to define openings 107 for ink guiding portions of nozzles 106. The patterning of the first photoresist $PR_1$ may be performed by known photolithography including exposure and development.

Referring to FIG. 7C, portions of the upper first silicon oxide layer 131*b* exposed through the openings 107 are wet-etched using the patterned first photoresist $PR_1$ as an etching mask to partially expose an upper surface of the silicon substrate 130. The first photoresist $PR_1$ is then stripped. Alternatively, the exposed portions of the upper first silicon oxide layer 131*b* may be removed by dry-etching, e.g., reactive ion etching (RIE), instead of wet-etching.

Referring to FIG. 7D, exposed portions of the silicon substrate 130 are etched to a predetermined depth using the upper first silicon oxide layer 131*b* as an etching mask to form the ink guiding portions 106*a*. When the silicon substrate 130 is anisotropically wet-etched using tetramethyl ammonium hydroxide (TMAH) or potassium hydroxide (KOH) as an etchant, the ink guiding portions 106*a* may be formed in a square pyramidal shape having slanted sidewalls.

Referring to FIG. 7E, a second photoresist $PR_2$ is coated on an entire surface of the lower first silicon oxide layer 131*a* formed on the lower surface of the silicon substrate 130. The coated second photoresist $PR_2$ is then patterned to expose a portion of the lower first silicon oxide layer 131*a* intended for the heater 134, as shown in FIG. 3. As described above, the second photoresist $PR_2$ may be patterned in a different manner according to the arrangement of the heater 134. Further, portions of the lower first silicon oxide layer 131*a* intended for a temperature detector 138 and nozzle metal layers 136 may also be exposed concurrently with the portion intended for the heater 134.

Referring to FIG. 7F, a metal material is sputtered on the patterned second photoresist $PR_2$ and all exposed portions of the lower first silicon oxide layer 131*a* to form a metal layer M. The metal material may be Pt, as described above.

FIG. 7G illustrates the silicon substrate 130 after the heater 134, the bonding pads 135, the temperature detector 138, and the nozzle metal layers 136 are formed on the lower surface of the silicon substrate 130. More specifically, when the second photoresist $PR_2$, shown in FIG. 7F, is lifted-off, the second photoresist $PR_2$ and portions of the metal layer M formed on the surface of the second photoresist $PR_2$ are removed and portions of the metal layer M formed on the exposed surface of the lower first silicon oxide layer 131*a* remain. The remaining portions of the metal layer M, i.e., a residual metal layer, form the heater 134, the bonding pads 135, the temperature detector 138, and the nozzle metal layers 136.

Referring to FIG. 7H, a protection layer 132, e.g., a second silicon oxide layer is deposited to protect the heater 134, the bonding pads 135, the temperature detector 138, and the nozzle metal layers 136, on the entire lower surface of the resultant structure of FIG. 7G. The second silicon oxide layer 132 may be deposited by plasma-enhanced chemical vapor deposition (PECVD). However, if the heater 134, the bonding pads 135, the temperature detector 138, and the nozzle metal layers 136 are too thick, a smoothness of the second silicon oxide layer 132 may be decreased, thereby affecting subsequent photoresist coating and patterning. In this case, the second silicon oxide layer 132 may be planarized by chemical mechanical polishing (CMP) prior to subsequent operations.

Referring to FIG. 7I, a third photoresist $PR_3$ is coated on an entire surface of the second silicon oxide layer 132 and patterned to form openings 108 at positions corresponding to the ink guiding portions 106*a*.

Referring to FIG. 7J, the second silicon oxide layer 132 and the lower first silicon oxide layer 131*a* are sequentially dry-etched through the openings 108 using the third photoresist $PR_3$ as an etching mask and then the third photoresist $PR_3$ is stripped. As a result, the nozzle metal layers 136 and a lower surface of the silicon substrate 130 are exposed through the openings 108.

FIG. 7K illustrates the silicon substrate 130 after formation of the nozzles 106 composed of the ink guiding portions 106*a* and the ink outlets 106*b*. More specifically, the ink outlets 106*b* in communication with the ink guiding portions 106*a* are bored through the exposed portions of the silicon substrate 130 by etching. This etching may be performed by dry-etching the silicon substrate 130 by inductively coupled plasma (ICP) using the nozzle metal layers 136 as etching masks.

Referring to FIG. 7L, a fourth photoresist $PR_4$ is coated on an entire lower surface of the resultant structure of FIG. 7K. The fourth photoresist $PR_4$, which may be a dry film photoresist, is formed on the surface of the second silicon oxide layer 132 by a lamination process using heating and pressing. The dry film fourth photoresist $PR_4$ is advantageously used because such a photoresist does not enter into the nozzles 106. The fourth photoresist $PR_4$ is then patterned to form openings 109 at positions corresponding to the bonding pads 135 of the heater 134.

Referring to FIG. 7M, portions of the second silicon oxide layer 132 exposed through the openings 109 are etched using the patterned fourth photoresist $PR_4$ as an etching mask, to form the contact holes C exposing the bonding pads 135 of the heater 134.

Meanwhile, in the steps shown in FIGS. 7L and 7M, contact holes (not shown) exposing the bonding pads 139 of the temperature detector 138, as shown in FIG. 3, may additionally be formed concurrently with the contact holes C.

Subsequently, stripping of the fourth photoresist $PR_4$ with acetone or the like completes the nozzle plate 130 through which the nozzles 106 are bored and including the heater 134, the bonding pads 135, the temperature detector 138, and the nozzle metal layers 136 on a lower surface of the nozzle plate 130.

As described above, to impart good hydrophobicity to the nozzles 106, a good hydrophobic metal material, e.g., Au, may be coated on surfaces of the nozzle metal layers 136 to form the hydrophobic plating layers 137. More specifically, the hydrophobic plating layers 137 may be formed by Au electroplating on surfaces of the previously formed nozzle metal layers 136 used as seed layers. At this time, even though the metal material, i.e., Au, may also be coated on exposed surfaces of the bonding pads 135, the bonding pads 135 are not adversely affected due to the conductivity of the metal material coated on the surfaces of the bonding pads 135.

In this way, according to an embodiment of the present invention, formation of the hydrophobic plating layers 137 is possible even without deposition and patterning of a metal material for formation of a separate seed layer.

As is apparent from the above description, in an ink-jet printhead according to an embodiment of the present invention, a heater for heating ink is integrally formed with a nozzle plate, thereby simplifying the structure of the ink-jet printhead and decreasing a manufacturing cost. Furthermore, since ink in the printhead is heated to a uniform temperature, ejection speed and volume of ink droplets through plural nozzles are maintained uniform, thereby enhancing printing quality.

By way of further advantage, since a temperature detector for detecting ink temperature is integrally formed with a nozzle plate or a piezoelectric actuator, ink temperature may be more accurately detected. Thus, active and accurate temperature control with respect changes in ink temperature is possible, thereby enhancing printing quality.

In addition, since a heater metal layer and a nozzle metal layer surrounding a nozzle are formed concurrently on a surface of a nozzle plate and a hydrophobic plating layer is formed on a surface of the nozzle metal layer, ink ejection performance such as directionality, volume, and ejection speed of ink droplets are enhanced, thereby enhancing printing quality.

Further, the nozzle metal layer surrounding the nozzle serves as an etching mask for formation of an ink outlet of the nozzle. This configuration enables accurate and easy formation of the ink outlet and formation of the hydrophobic plating layer, without requiring deposition and patterning of a metal material for formation of a separate seed layer.

Exemplary embodiments of the present invention have been disclosed herein and, although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A piezoelectric ink-jet printhead, comprising:

a flow path plate having an ink flow path including a plurality of pressure chambers to be filled with ink to be ejected;

a piezoelectric actuator formed on an upper surface of the flow path plate and for supplying a driving force for ink ejection to the plurality of pressure chambers;

a nozzle plate having an upper surface and a lower surface, the upper surface of the nozzle plate bonded to a lower surface of the flow path plate including a plurality of nozzles for ejecting ink from the plurality of pressure chambers through the nozzle plate;

a heater formed on the lower surface of the nozzle plate, the heater adapted to heat ink in the ink flow path;

an insulating layer between the lower surface of the nozzle plate and the heater, the heater being formed in a predetermined pattern on a surface of the insulating layer;

a protection layer for protecting the heater formed on the insulating layer and the heater;

bonding pads for bonding a power supply line formed at ends of the heater; and contact holes through the protection layer for exposing the bonding pads.

2. The piezoelectric ink-jet printhead as claimed in claim 1, wherein each of the insulating layer and the protection layer is a silicon oxide layer.

3. The piezoelectric ink-jet printhead as claimed in claim 1, further comprising a temperature detector for detecting a temperature of ink in the ink flow path.

4. The piezoelectric ink-jet printhead as claimed in claim 3, wherein the temperature detector is formed of a metal material having a variable resistance with respect to temperature.

5. The piezoelectric ink-jet printhead as claimed in claim 3, wherein the temperature detector is formed on a lower surface of the nozzle plate concurrently with the heater.

6. The piezoelectric ink-jet printhead as claimed in claim 5, wherein the heater and the temperature detector are formed of a same metal material.

7. The piezoelectric ink-jet printhead as claimed in claim 6, wherein the heater and the temperature detector are formed of platinum (Pt).

8. The piezoelectric ink-jet printhead as claimed in claim 5, further comprising bonding pads for bonding a temperature detection signal line formed at ends of the temperature detector.

9. The piezoelectric ink-jet printhead as claimed in claim 3, wherein the temperature detector is formed on an upper surface of the flow path plate concurrently with the piezoelectric actuator.

10. The piezoelectric ink-jet printhead as claimed in claim 9, wherein the piezoelectric actuator includes a lower electrode and the temperature detector is formed on a same plane using a same metal material as the lower electrode of the piezoelectric actuator.

11. The piezoelectric ink-jet printhead as claimed in claim 10, wherein the temperature detector and the lower electrode are formed of platinum (Pt).

12. The piezoelectric ink-jet printhead as claimed in claim 10, wherein the temperature detector is bounded by a trench extending through the lower electrode and is insulated from the lower electrode by the trench.

13. The piezoelectric ink-jet printhead as claimed in claim 10, further comprising:

a connection electrode for connecting the temperature detection signal line to the temperature detector; and a dummy piezoelectric layer for supporting the connection electrode, the connection electrode and the dummy piezoelectric layer being formed on the lower electrode.

14. The piezoelectric ink-jet printhead as claimed in claim 3, further comprising nozzle metal layers formed around the nozzles on the lower surface of the nozzle plate.

15. The piezoelectric ink-jet printhead as claimed in claim 1, further comprising nozzle metal layers formed around the nozzles on the lower surface of the nozzle plate.

16. The piezoelectric ink-jet printhead as claimed in claim 15, wherein the nozzle metal layers have a circular ring shape.

17. The piezoelectric ink-jet printhead as claimed in claim 15, wherein the heater and the nozzle metal layers are formed on a same plane using a same metal material.

18. The piezoelectric ink-jet printhead as claimed in claim 17, wherein the heater and the nozzle metal layers are formed of platinum (Pt).

19. The piezoelectric ink-jet printhead as claimed in claim 15, further comprising hydrophobic plating layers formed on the nozzle metal layers.

20. The piezoelectric ink-jet printhead as claimed in claim 19, wherein the hydrophobic plating layers are formed of gold (Au).

21. A piezoelectric ink-jet printhead, comprising:

a flow path plate having an ink flow path including a plurality of pressure chambers to be filled with ink to be ejected;

a piezoelectric actuator for supplying a driving force for ink ejection to the plurality of pressure chambers, the piezoelectric actuator including a lower electrode on the flow path plate;

a nozzle plate bonded to a lower surface of the flow path plate including a plurality of nozzles for ejecting ink from the plurality of pressure chambers through the nozzle plate; and a temperature detector for detecting a temperature of ink in the ink flow path formed on the flow path plate, the temperature detector being positioned between portions of the lower electrode of the piezoelectric actuator.

22. The piezoelectric ink-jet printhead as claimed in claim 21, the piezoelectric actuator comprising a lower electrode formed on an upper surface of the flow path plate, a piezoelectric layer formed on the lower electrode, and an upper electrode formed on the piezoelectric layer, and wherein the temperature detector is formed on the upper surface of the flow path plate integrally with the piezoelectric actuator.

23. The piezoelectric ink-jet printhead as claimed in claim 21, wherein the temperature detector is formed on a same plane as the lower electrode of the piezoelectric actuator and is formed of a metal material having a variable resistance with respect to temperature.

24. The piezoelectric ink-jet printhead as claimed in claim 23, wherein the temperature detector and the lower electrode are formed of platinum (Pt).

25. The piezoelectric ink-jet printhead as claimed in claim 21, wherein the temperature detector is bounded by a trench extending through the lower electrode and is insulated from the lower electrode by the trench.

26. The piezoelectric ink-jet printhead as claimed in claim 22, further comprising:

a connection electrode for connecting a temperature detection signal line to the temperature detector; and a dummy piezoelectric layer for supporting the connection electrode, the connection electrode and the dummy piezoelectric layer being formed on the lower electrode.

27. The piezoelectric ink-jet printhead as claimed in claim 26, wherein the dummy piezoelectric layer is disposed in parallel to the piezoelectric layer on the lower electrode and an end of the dummy piezoelectric layer extends onto the temperature detector, and wherein the connection electrode is formed on an upper surface of the dummy piezoelectric layer and an end of the connection electrode extends beyond the end of the dummy piezoelectric layer and contacts an upper surface of the temperature detector.

28. The piezoelectric ink-jet printhead as claimed in claim 27, wherein a height of the dummy piezoelectric layer is the same as a height of the piezoelectric layer.

29. The piezoelectric ink-jet printhead as claimed in claim 1, wherein the heater is only on a portion of the lowermost surface of the nozzle plate.

30. The piezoelectric ink-jet printhead as claimed in claim 1, wherein the heater includes a plurality of linear portions.

31. The piezoelectric ink-jet printhead as claimed in claim 1, wherein a cross-section of the heater along a plane parallel to a surface supporting the printhead has a zig-zag structure.

32. The piezoelectric ink-jet printhead as claimed in claim 1, wherein a cross-section of the heater along a plane perpendicular to a surface supporting the printhead includes a plurality of discrete portions.

33. The piezoelectric ink-jet printhead as claimed in claim 1, wherein the protection layer is in direct contact with at least three surface of the heater.

* * * * *